US005822271A

United States Patent [19]

Ead et al.

[11] Patent Number: 5,822,271

[45] Date of Patent: Oct. 13, 1998

[54] SUBMARINE PORTABLE VERY LOW FREQUENCY ACOUSTIC AUGMENTATION SYSTEM

[75] Inventors: Richard M. Ead, Wakefield; Robert L. Pendleton, Portsmouth, both of R.I.

[73] Assignee: The United States of America as represented by the Secretary of the Navy, Washington, D.C.

[21] Appl. No.: 56,041

[22] Filed: Apr. 1, 1998

[51] Int. Cl.[6] ..... H04K 3/00

[52] U.S. Cl. ..... 367/1; 367/137

[58] Field of Search ..... 367/1, 137, 165; 434/6, 10

[56] References Cited

U.S. PATENT DOCUMENTS 5,144,587 9/1992 Mason ..... 367/1

5,247,894 9/1993 Haisfield et al. ..... 367/1

*Primary Examiner*—Daniel T. Pilhulic

*Attorney, Agent, or Firm*—Michael J. McGowan; Robert W. Gauthier; Prithvi C. Lall

[57] ABSTRACT

A very low frequency augmentation system consists of a mobile target very low frequency projector (VLFP) adapted for operation as an augmentation device and installed within a torpedo shell housing. The housing is loaded within the torpedo tube of a submarine. A control and power interface is provided between the housing and the submarine to operate and monitor the augmentation device from the submarine. The housing is loaded in one of the submarine's torpedo tubes and the tube is flooded. The VLFP transmits low frequency vibrations into the surrounding seawater, acting as an augmentor.

12 Claims, 1 Drawing Sheet

SUBMARINE PORTABLE VERY LOW FREQUENCY ACOUSTIC AUGMENTATION SYSTEM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to augmentation devices used in sonar training, and more particularly to a portable very low frequency augmentation system.

(2) Description of the Prior Art

Augmentation devices are used to augment the acoustic signature of a submarine and also to replicate potential submarine threat platform acoustic signatures. Using such devices allows for training in identifying such threats. Such devices require the generation of very low frequency acoustic signals. Mobile targets can also be used to replicate acoustic signatures and are used as training devices. Recent research in mobile targets has led to the development of a very low frequency projector. However, the use of mobile targets is confined to designated training ranges. Since submarine missions may require extended periods at sea away from such training ranges, there exists a need to provide interim training while the submarine is at sea. For training outside of a designated training range, devices currently in use consist of electro-mechanical vibrators bolted to the inside of a submarine ballast tank. The installation of these devices requires that an initial foundation be installed in the ballast tank with diver services required for follow-on installation or removal of the devices for maintenance and repair. Due to the costs and time involved, such devices are installed on a very limited number of submarines. In threat recognition training, these submarines are used as dedicated training platforms.

Decoys and countermeasures have been developed which provide acoustic signals meant to deceive a receiver. While intended for use at sea, such decoys and countermeasures are launched away from the submarine. For example, U.S. Pat. No. 5,144,587 to Mason recites an expendable echo radiator. The device is launched from a submarine to lure incoming torpedoes away from the submarine. However, the device cannot be used to replicate the acoustic signatures of potential submarine threats, especially the very low frequency portion of the acoustic signature. Even if the generated signal from the device could be made to simulate the acoustic signature of a threat, the acoustic signature of the launch from a submarine would be noncompatible to the threat signature. Additionally, being expendable, the device would only be capable of a single training exercise. U.S. Pat. No. 5,247,894 to Haisfield et al. provides a decoy similar to that of Mason which simulates the evasive tactics of a submarine under attack. The decoy picks up and records sonar signals sent out from an attacking threat platform and returns the signals such that the threat platform follows the sonar signals of the decoy rather than the submarine under attack. As with the Mason device, the Haisfield et al. decoy cannot be used as an augmentation device.

SUMMARY OF THE INVENTION

Accordingly, it is an object of the present invention to provide an augmentation system which can be easily installed on a submarine.

Another object of the present invention is to provide an augmentation system which does not require launching from the submarine for operation.

Still another object of the present invention is to provide an augmentation system which can be utilized away from training ranges.

A further object of the present invention is to provide an augmentation system which is portable from submarine to submarine such that no single submarine need be dedicated as a training platform.

A still further object of the present invention is to provide an augmentation system which can simulate the very low frequency portion of an acoustic signature with an extremely high fidelity response.

Other objects and advantages of the present invention will become more obvious hereinafter in the specification and drawings.

In accordance with the present invention, a very low frequency augmentation system is provided which may be removably placed within the submarine. The system consists of adapting a mobile target very low frequency projector (VLFP) for operation as an augmentation device such that the VLFP simulates the very low frequency portion of an acoustic signature with an extremely high fidelity response. In addition, the VLFP operates to depths in excess of one thousand feet with no degradation in performance. The adapted VLFP is installed within a torpedo shell housing and the torpedo shell housing is mounted within the torpedo tube of a submarine. A control and power interface is provided from the submarine to the device. The system can be easily installed aboard a submarine as the housing can be loaded together with standard torpedoes. The augmentation device operates within the torpedo tube of a submarine and thus launching from the submarine is not required for operation. The control and power interface resides aboard the submarine such that the augmentation device does not require the use of a dedicated training range for operation. The ease of installation allows the system to be used aboard more than one submarine, either by having systems aboard various submarines or by transferring a single system between submarines.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
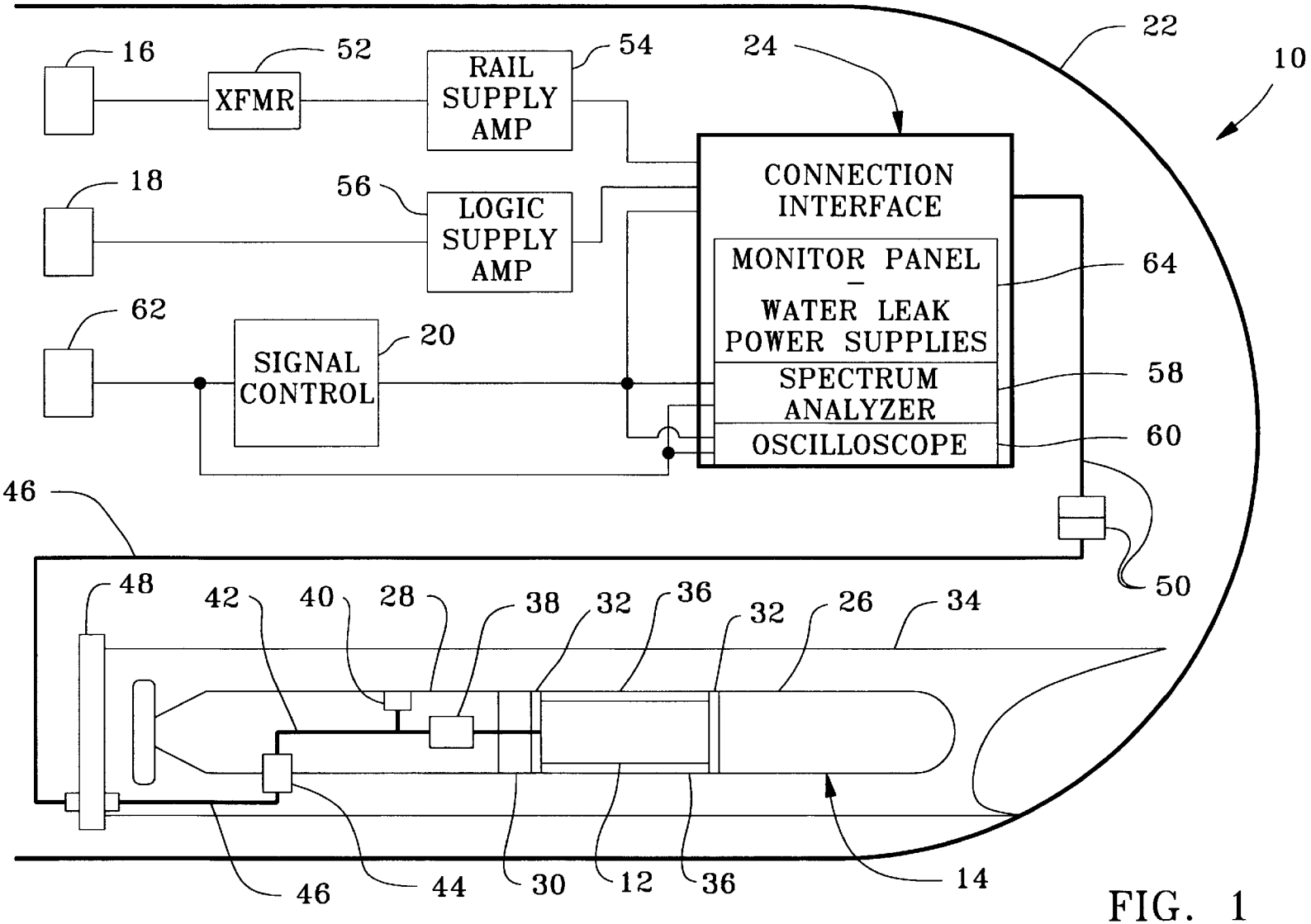
FIG. 1 is a schematic representation of a very low frequency acoustic augmentation system.

Referring now to FIG. 1, there is shown a schematic representation of the augmentor system 10 of the present invention. VLFP 12 is installed within torpedo shell housing 14 and is connected to rail power supply 16, logic power supply 18 and signal control 20 of submarine 22 via interface 24. Torpedo shell housing 14 can be any standard torpedo shell in use by the fleet. Installing VLFP 12 in a standard torpedo shell allows handling VLFP 12 without modification to existing handling equipment. In the preferred embodiment, housing 14 is a MK 48 torpedo shell, in wide use throughout the fleet. VLFP 12 is installed between nose and transducer section 26 of housing 14 and forward fuel tank section 28, replacing the control section of the MK 48 torpedo shell. VLFP 12 is fitted with adapter section 30 and flanges 32 so as to mate with sections 26 and 28 of housing 14 and maintain the overall length of housing 14. In operation, housing 14, with VLFP 12 installed, is inserted into torpedo tube 34 of submarine 22 and torpedo tube 34 is flooded. Elastomeric membrane 36 surrounds VLFP 12 so as to transmit acoustic pulses to the surrounding medium. Fuel tank section 28 is modified to accommodate VLFP amplifier 38, leak detector 40 and wiring harness 42. VLFP amplifier 38 receives signals from signal control 20 and drives VLFP 12 to generate the acoustic pulses. Leak detector 40 monitors housing 14 for water leaks which could damage VLFP 12 and associated electronic components. Wiring harness 42 connects VLFP 12, VLFP amplifier 38 and leak detector 40 to a standard torpedo shell cable connection 44. Standard torpedo cabling 46 passes through torpedo tube breech door 48 and mates with cable interface 50. Cable interface 50 provides the proper pin connection interface between torpedo cabling 46 and connection interface 24. Connection 24 receives VLFP operating power from rail power supply 16 via step down transformer 52 and rail supply amplifier 54. Logic power supply 18 provides operating power for VLFP logic circuits (not shown) to connection interface 24 via logic power supply amplifier 56. Signal control 20 provides VLFP input signals to connection interface 24. Additionally, signal control 20 provides control signals to spectrum analyzer 58 and oscilloscope 60 used to monitor the operation of VLFP 12. In the preferred embodiment shown, spectrum analyzer 58 and oscilloscope 60 are contained within connection interface 24. This configuration provides a compact system which saves valuable space within submarine 22 and which can be easily relocated between submarines. Separate control power supply 62 provides control power to signal control 20, spectrum analyzer 58 and oscilloscope 60. Connection interface 24 also contains monitor panel 64, for monitoring power supplies 16 and 18 as well as leak detector 40.

The invention thus described provides a very low frequency augmentation system utilizing a VLFP installed within a torpedo shell housing and a connection interface for delivering power and control signals from a submarine to the VLFP. In the preferred embodiment, the VLFP, including mounting flanges and an adapter section, replaces the control section of the torpedo shell housing and the housing is modified to accept the driving amplifier for the VLFP, a leak detector and a wiring harness connecting these components to a standard cable connection on the torpedo housing. A water tight elastomeric membrane surrounds the VLFP and is used to transmit acoustic pulses from the VLFP to the surrounding medium. During operation, the torpedo shell housing is installed in the torpedo tube of a submarine and the tube is flooded. The standard torpedo cable is connected to the standard cable connection on the torpedo. The standard torpedo cable, in turn, is connected to a system cable interface which properly aligns the pin connections within the torpedo cable for connection to the connection interface. The connection interface bridges between the power supplies and signal control of the submarine and the system cable interface. It can be seen that the system can be easily installed on existing submarines. The VLFP is housed within a torpedo shell which can replace one of the existing torpedoes aboard a submarine. Handling of the VLFP housing is accomplished in the same manner as standard torpedoes, thus no new handling equipment is required. The housing is connected to the connection interface via standard cables and connections. The connection interface connects directly to the ship's power and signal control equipment. The ease of installation also allows for the easy transfer of the system from one submarine to another, thus no single submarine need be dedicated as a training platform. With the torpedo tube flooded, the VLFP can project the necessary low frequency acoustic signals for operation. Neither the VLFP nor its housing need be launched from the submarine for operation. As the system replaces one of the submarine's standard torpedoes, it can be carried aboard a submarine until training is required and can then be operated without requiring a dedicated training range.

Although the present invention has been described relative to a specific embodiment thereof, it is not so limited. The connection interface may be configured to include the transformer and power supplies of FIG. 1, such that simple plug connections can be made into the submarine power supply. In the embodiment of FIG. 1, the VLFP is a prototype model. The VLFP may be reconfigured to better adapt to the torpedo housing, i.e., the flanges, adapter section and elastomeric membrane may be modified to fit the VLFP used.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An augmentation system comprising:

an acoustic projector emitting a very low frequency acoustic signal;

a housing in the shape of a torpedo, the projector being installed within the housing; and a connection interface connected between the projector and power supplies of a submarine providing power to the projector, the connection interface further connected between the projector and a signal control of the submarine controlling the acoustic signal.

2. The augmentation system of claim 1, wherein the projector and housing are mounted within a torpedo tube of the submarine, the torpedo tube being flooded with seawater to transmit the acoustic signal from the projector to the seawater.

3. The augmentation system of claim 1, wherein the connection interface further comprises:

a spectrum analyzer analyzing the spectrum of the signal being emitted;

an oscilloscope displaying characteristics of the signal being emitted; and a monitor panel monitoring the power supplied to the projector.

4. The augmentation system of claim 3, wherein the housing further comprises a leak detector monitoring the presence of water within the housing.

5. The augmentation system of claim 4, wherein the monitor panel further comprises a display indicating a status of the leak detector.

6. The augmentation system of claim 1, further comprising:

a standard torpedo cable connection attached to the housing; and a first connection between the connection interface and the standard torpedo cable connection, the first connection aligning pin connections of the standard torpedo cable connection with pin connections of the connection interface, the first connection transmitting power and signal control to the projector.

7. The augmentation system of claim 2, wherein the projector further comprises:

an adapter section mating with a rearward section of the housing; and a flange section mating with a forward section of the housing.

8. The augmentation system of claim 7, further comprising an elastomeric covering spanning between the adapter section and the flange section, the covering generally maintaining the shape of the housing, protecting the projector from the surrounding seawater and facilitating the transmission of the acoustic signal from the projector to the seawater.

9. The augmentation system of claim 8, further comprising:

a standard torpedo cable connection attached to the housing; and a first connection between the connection interface and the standard torpedo cable connection, the first connection aligning pin connections of the standard torpedo cable connection with pin connections of the connection interface, the first connection transmitting power and signal control to the projector.

10. The augmentation system of claim 9, wherein the connection interface further comprises:

a spectrum analyzer analyzing the spectrum of the signal being emitted;

an oscilloscope displaying characteristics of the signal being emitted; and a monitor panel monitoring the power supplied to the projector.

11. The augmentation system of claim 10, wherein the housing further comprises a leak detector monitoring the presence of water within the housing.

12. The augmentation system of claim 11, wherein the monitor panel further comprises a display indicating a status of the leak detector.

* * * * *